United States Patent [19]

Bromley

[11] 4,327,915

[45] May 4, 1982

[54] DISPLAY PANEL FOR AN ELECTRONIC GAME AND METHOD OF EMPLOYING SAME

[75] Inventor: Eric Bromley, West Simsbury, Conn.

[73] Assignee: Coleco Industries, Inc., Hartford, Conn.

[21] Appl. No.: 158,698

[22] Filed: Jun. 12, 1980

Related U.S. Application Data

[63] Continuation of Ser. No. 921,347, Jul. 3, 1978, abandoned.

[51] Int. Cl.[3] ..... A63F 9/00

[52] U.S. Cl. ..... 273/94; 273/85 G; 340/323 R; 340/754; 340/782; 340/799

[58] Field of Search ..... 273/1 E, 1 GC, 85 G, 273/88, 93 R, 94, 313, 237, DIG. 28; 364/410; 340/323 R, 706, 768, 780, 791, 792, 800, 810, 799, 782

[56] References Cited

U.S. PATENT DOCUMENTS

| | | | |
|---|---|---|---|
| 2,883,193 | 4/1959 | Iannone et al. | 273/88 |
| 3,413,002 | 11/1968 | Welch | 273/93 R |
| 3,556,525 | 1/1971 | Pegg | 273/94 |
| 3,594,762 | 7/1971 | Gardberg et al. | 340/768 |
| 3,606,329 | 9/1971 | Wilson | 273/88 |
| 3,630,522 | 12/1971 | Bear | 273/94 |
| 3,638,215 | 1/1972 | Payne | 340/800 |
| 3,790,170 | 2/1974 | Alexander | 273/88 |
| 3,874,669 | 4/1975 | Ariano et al. | 273/85 G |
| 4,026,555 | 5/1977 | Kirschner et al. | 273/85 G |
| 4,053,740 | 10/1977 | Rosenthal | 273/85 G |
| 4,093,223 | 6/1978 | Wilke et al. | 273/94 |
| 4,111,421 | 9/1978 | Mierzwinski | 273/85 G |
| 4,162,792 | 7/1979 | Chang et al. | 273/94 R |

OTHER PUBLICATIONS

*Electronics;* "Strobed LED Display Breaks the Design Cost Barrier;" Jan. 17, 1972; pp. 64–67.

*Electronic Design;* "Nonvideo Games Pit Man vs Microprocessor;" May 10, 1977; p. 21.

*Mattel Electronics® Football Game Instructions;* 1977.

Bless, G.; "Electronic Table Top Football;" *Funkschau;* Jul. 1975; pp. 91–94.

*Primary Examiner*—Vance Y. Hum

[57] ABSTRACT

An electronic simulated football game includes provision for displaying and moving a multiplicity of offensive players on a display panel that includes an array of light-emitting diodes in response to commands entered from a keyboard to an operational circuit that controls the display. The provision of more than one offensive player affords the possibility of simulating blocking and passing, provisions for which are made in the operational circuit. Additionally, the operational circuit controls the display to provide and move a symbol representing a football during passing and kicking plays. Finally, status information, such as the score and the down number, is displayed on the same part of the display panel as that on which play action is shown.

10 Claims, 17 Drawing Figures

DISPLAY PANEL FOR AN ELECTRONIC GAME AND METHOD OF EMPLOYING SAME

This application is a continuation of U.S. Pat. application Ser. No. 921,347 filed July 3, 1978, now abandoned.

BACKGROUND OF THE INVENTION

The present invention relates to the general field of electronic games, particularly that type of electronic game that simulates a field game such as football.

Indoor games for simulating field games such as football by manipulating tokens that simulate the players of such field games have long been known to the art. More recently, electronic games that move player symbols electronically have appeared on the scene, the most relevant to the present discussion being the type of electronic football game in which a display panel is provided that includes an array of light-emitting devices whose illumination forms symbols for players of the simulated game. The electronic device itself determines movements for the defensive players, normally in a pseudo-random manner so that the operator is not able to anticipate the moves of the defender symbols, while the operator gives commands to cause movement of an offensive player. The simulated play action is monitored to record status information, which is displayed in a separate display area using separate LED's.

SUMMARY OF THE INVENTION

The present invention affords an improvement over the prior art by requiring less hardware for displaying the simulated sports action and conveying the status information. According to the present invention, an apparatus for simulating a sports-action game includes a display panel having a transparent planar upper surface and including an array of light-emitting devices disposed below it that are operable to emit light by the application of electrical signals thereto. Operational-circuit means are also included that are operatively connected to the display panel. The operational-circuit means include means for generating and transmitting electrical signals to at least some of the light-emitting devices in order to illuminate them and simulate at least one object. Some of the devices are illuminated sequentially to simulate at least one moving object whose simulated motion represents the play action of the simulated game. The operational-circuit means further includes means for monitoring the play action to record information concerning the status of the simulated game and for generating and transmitting electrical signals to at least some of the light-emitting devices to illuminate them to display the status information. At least some of the light-emitting devices that are illuminated to simulate the object are also illuminated to display the status information.

Preferably, the monitoring means generates and transmits signals to at least some of the light-emitting devices to illuminate them to form alpha-numeric symbols that convey the status information. This is conveniently accomplished if at least some of the light-emitting devices are positioned to form a standard seven-segment display pattern.

In one embodiment of the invention, the light-emitting devices are light-emitting diodes.

The apparatus may also include a housing adapted to be held in a human hand. The operational-circuit means would then be contained in the housing, which would have the display panel mounted on it.

In the preferred embodiment, the planar upper surface has a simulated playing field inscribed on it above the light-emitting devices. The display panel further includes at least one lens, positioned between the planar surface and at least one of the light-emitting devices, for magnifying the image of at least one of the light-emitting devices. Preferably, the lenses are organized into at least two rows. The display panel also includes circuit-board means disposed below the light-emitting devices, and the light-emitting devices are mounted on the circuit-board means. The circuit-board means include conductor paths and circuit-board terminals in which the conductor paths terminate. The conductor paths are electrically connected to the light-emitting devices for illumination of selected light-emitting devices upon application of electrical signals to selected circuit-board terminals. The operational-circuit means are operatively connected to the circuit-board terminals to transmit the electrical signals to it so as to simulate the object and display the status information.

The method for playing the game includes the display panel and operational-circuit means as before. The method also includes providing a set of manually operable control elements electrically connected to the operational-circuit means for transmission of electrical signals to the operational-circuit means. The operational-circuit means are arranged for alternate selection of object simulation and status-information display in response to electrical signals transmitted for the manually operable control elements. The manually operable control elements are operated, according to the method, to alternately select simulation of the objects and display of the status information, so some of the same light-emitting devices are used for alternately simulating the objects and displaying the status information.

Preferably, the simulated motion is at least partially controllable by electrical signals transmitted to the operational-circuit means by operation of the manually operable control elements, and the method further includes operating the manually operable control elements to control the simulated motion.

BRIEF DESCRIPTION OF THE DRAWINGS

These and further features and advantages of the present invention can be appreciated by reference to the attached drawings, in which.

DETAILED DESCRIPTION OF THE PREFERRED EMBODIMENT

Figure 1:
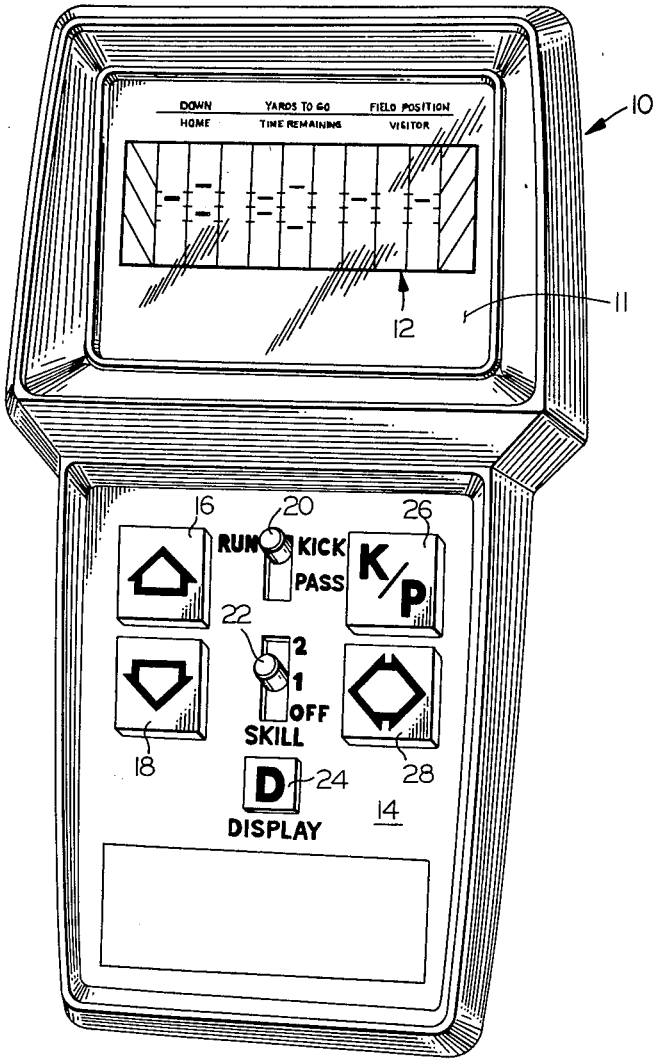
FIG. 1 is a perspective view of the apparatus of the preferred embodiment.

The preferred embodiment of an apparatus for an electronic football game using a multiplicity of offensive players is illustrated in FIG. 1. It consists of a housing 10 having the general size and shape of a hand-held calculator. A display panel 12 is mounted in one end of the housing, and a control board 14 occupies the other end of the housing. The display panel includes a matrix of light-emitting diodes. A transparent planar surface 11 mounted in housing 10 covers the diode matrix and bears lines that simulate the yard lines on a football field. During play, the apparatus itself displays a multiplicity of relatively dim symbols representing moving defensive players in a variable manner, that is, in a manner that appears unpredictable to the operator, by successively lighting adjacent segments of the LED display. Offensive players are symbolized by brighter LED's and the symbol for the offensive player denominated the ball carrier flashes on and off. Unlike the defensive players, the offensive players are moved in a controlled manner, being directed by the operator from the control board. A switch 20 in the upper central portion of the control board 14 is operated to indicate whether the operator intends to pass, on the one hand, or run or kick on the other. Should he indicate a running play, he can move the ball carrier up or down with the up button 16, which is labeled with an arrow pointing up, or the down button 18, which is labeled with an arrow pointing down. He can also move the ball carrier downfield by operating the downfield button 28, which is labeled with a double-headed horizontal arrow. Pressing the downfield button 28 causes the ball carrier to move left or right, depending on which side has the ball. In the typical game, two people would be playing, the person whose team is on offense being the one operating the controls.

There being a multiplicity of offensive players, operation of directional buttons 16, 18, or 28 during a running play will cause all of the offensive players to move in tandem; that is, the offensive players maintain their positions with respect to each other as they move along the field. This is in contrast to a pass play (indicated by the pass run/switch 20), in which the directional keys 16, 18, and 28 move only the offensive player denominated the receiver while the ball carrier and the remaining offensive players remain stationary. The ball carrier can be moved during a pass play only upon completion, when the erstwhile receiver becomes the ball carrier.

The remaining manually operable control elements on the control board 14 are a three-position switch 22 located in the center of the control board 14, a key located below it and labeled with a D, and a key 26 whose label reads "K/P." The three-position switch 22 is provided for turning on the unit and indicating which level of skill is desired. The choice of a skill level determines the initial number of defenders and also has other effects detailed below. The "D" key 24 resets the unit after a play and causes status information such as the score and the time remaining to appear on the display panel. Execution of a pass or a kick, depending on the position of switch 20, is effected by operation of the "K/P" key 26.

Not shown in FIG. 1 are openings on the reverse side of the housing 10 provided for transmission of sound waves from a sound-generating device located inside the unit. The sound-generating device provides various sounds for purposes such as indicating the occurrence of a tackle, a turnover, or a score.

The operation of the unit is controlled by a microprocessor chip, shown in FIG. 12A, that has been programmed to carry out the functions detailed below and suggested by the diagram of FIG. 2. Instructions can be entered from the control board, indicated by block 46. An operational circuit, indicated by dashed lines 32, receives signals from the control board 46 and processes them to display action on the display panel 30. The operational circuit 32, which includes the microprocessor, also controls the sound-generating device, indicated by reference numeral 48.

Figure 5:
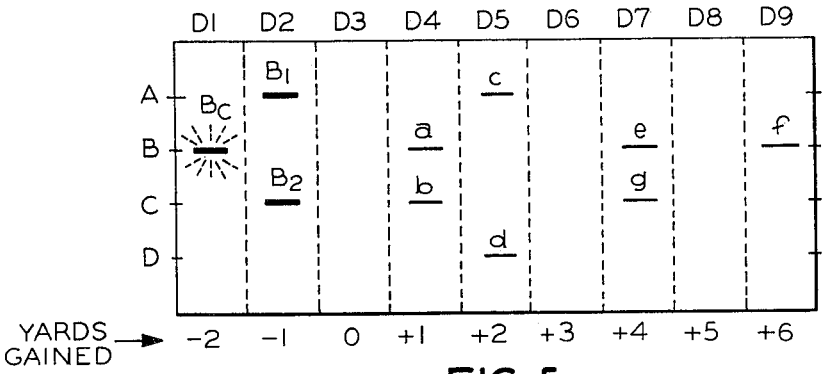

The operational-circuit means is programmed to generate and transmit signals to the display panel 30 to produce symbols on the simulated playing field that represent offensive and defensive players. Specifically, offensive players are simulated by brightly illuminated LED segments such as those indicated in FIG. 5 by the references $B_c$, $B_1$, and $B_2$. Player $B_c$ is distinguished by blinking on and off, and this indicates that $B_c$ is the ball carrier. The operational-circuit means also generates signals for placing symbols for defensive players on the display panel. The defensive players are indicated in Figures by the references a, b, c, d, e, f, and g. By appropriate programming, the operational-circuit means is made to include an offensive-player-motion means, indicated by box 34 of FIG. 2, that moves the offensive players according to directions from the control panel 46. When the run/pass switch 20 (FIG. 1) is operated to the "RUN" position, all of the players are positioned at the beginning of play as indicated in FIG. 5. Defensive player g may or may not be present, depending upon the position of the three-position switch 22; defensive player g is only provided when switch 22 is in position 2, not position 1.

All players remain in their FIG. 5 positions until one of the directional buttons 16, 18, and 28 is pressed. Each operation of one of these directional buttons causes all three offensive players to move one position in the direction indicated by the operated button. Operation of the up button 16 or down button 18 can cause one of the blockers $B_1$ or $B_2$ to be moved off the display, but the ball carrier $B_c$ cannot be moved off the display, and an attempt to do so causes the ball carrier and remaining blocker to remain stationary. If the players start in the positions of FIG. 5, for example, one operation of the up button 16 causes players $B_c$ and $B_2$ both to move up by one position. $B_1$ (which moves off the display) disappears. Further operation of the up button 16 causes no movement of the offensive players. If the down button 18 is then operated, offensive player $B_1$ will reappear in its original position, and players $B_c$ and $B_2$ will move back to theirs.

As was just explained, operation of any button once causes movement of the offensive players by one position; if a button is not pushed again, the offensive players remain stationary. This is not true of the defensive players; they begin motion in a variable manner when one of the directional buttons is first operated, and this motion continues regardless of whether further directional buttons are operated. This activity of the defensive players is caused by signals from the operational-circuit means 32, which is programmed to include means for moving the defensive players in a variable manner. This function is represented by block 36 of FIG. 2.

The defensive player to be moved is selected in a pseudo-random fashion. Of course, since the microprocessor is a completely determinate machine, the operation cannot be truly random. However, it is well known in the computer art to generate series of pseudo-random numbers. One of these types of methods is used by the defensive-motion means 36 to pick the defensive player to be moved. Once a defensive player is picked, a move is "randomly" picked from its repertoire of moves, and the move is executed on the display panel. The defensive-motion means then selects a player for the next move.

Each of the defensive players indicated by references a, b, c, d, and g, in FIG. 5 has a repertoire that consists only of forward movements until the player symbol reaches the same "yardline" as the ball carrier. They then move up or down towards the ball carrier. Defensive players e and f have a different repertoire, moving up or down toward the ball carrier's row or moving left or right toward the ball carrier's column. For example, if defender e is in column D7 and row A, and if the ball carrier is in row B and column D1, then defender e can either move to the left or down, and the defense-movement means picks one of these movements in a variable manner. (As previously indicated, the term variable manner is used here to denote the apparently random choice of players and moves).

According to the preferred embodiment of the present invention, the repertoire of a given defensive player depends upon the position of the ball carrier. Referring again to FIG. 5, all defensive players have the same repertoire as players e and f after the ball carrier reaches column D3.

One of the advantages of providing a multiplicity of offensive players is that blocking can be simulated. The operational-circuit means is programmed to provide this function, indicated in FIG. 2 by block 40, by detecting the coincidence on the field of an offensive player and a defensive player. According to the present invention, coincidence of a multiplicity of offensive players, not just of the ball carrier, can be detected independently, and this permits both blocking and tackling to be simulated. The apparatus of the preferred embodiment detects a coincidence between a defensive player and an offensive player other than the ball carrier and suppresses the display of both the offensive player and the defensive player until the end of the play. The end of the play occurs when there is a coincidence between the ball carrier itself and a defensive player. At that point motion stops, display of all players except the ball carrier is suppressed, and the unit must be reset by depressing the "D" button before a new play can be started.

It can be seen that this provision of more than one offensive player adds a new dimension to the game. With one offensive player, of course, no blocking is possible. But a unit that provides a multiplicity of offensive players permits provision to be made for detecting the independent coincidence of a multiplicity of offensive players with a multiplicity of defensive players, so blocking can be provided as well as tackling.

The operational-circuit means is further programmed to include means for monitoring the play action in order to record status information including the number of the down, the field position, the yardage needed for a first down, and the amount of time left in the game. This function is indicated by block 38 of FIG. 2. At the end of a down, the operator depresses the "D" key 24 to reset the unit for the start of the next play. Depressing the "D" button also causes the number of the down, the number of yards to go for first down, and the field position to be indicated on the playing-field portion of the display panel. An example of this is shown in FIG. 3, which shows third down, 13 yards to go on the six-yard line of the offense. The "u-6" means that the ball is at the offens's own six-yard line. Had the display read "d-6", the indication would be that the ball is at the defender's six-yard line.

Figure 4:
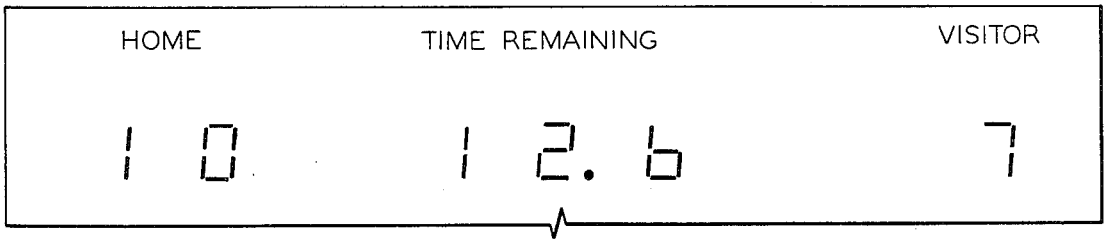
FIG. 4 is a simpler view of the same display showing the score and the amount of time remaining.

A second depression of the "D" button causes a display such as that shown in FIG. 4, in which the score and time remaining are indicated. As shown in FIG. 4, the score is 10 to 7 with 12.6 minutes of play remaining in the quarter. The end of the first quarter is indicated by an automatic display of the score without pressing the "D" button and a first-and-ten indication for the visiting team on its own twenty-yard line. The end of the game is indicated by the score and time being displayed automatically and the keyboard being disabled. In order to start a new game, the three-position switch 22 must be operated to OFF and then to position 1 or 2.

In order to execute a pass play, the pass/run switch 20 is operated to the "PASS" position. This puts the circuit into a mode in which it can simulate passes and indicate completions and receptions. The programming for detecting pass completions and receptions is indicated in FIG. 2 by block 42. According to the preferred embodiment, motion of the ball during a pass play is also simulated on the display panel 30, the ball simulation programming being indicated by block 44 of FIG. 2.

In order to understand the way in which a pass play is displayed on the display panel 30, a perusal of FIG. 3 is required. FIG. 3 shows that the display is an array 50 of LED segments. The array has nine columns of segments, and each column includes a standard seven-segment display digit and a decimal point. In addition, each column includes two horizontal segments located below the digit. Nineteen terminals 65 are located along the lower edge of the display panel, one for each column and one for each segment per column. In the first column, a standard seven-segment display is shown that is used during display of status information, but during play only two horizontal segments 52 and 56 are employed. The vertical segments as well as the middle horizontal segment 54 are not used while play action is being simulated. Further horizontal segments 60 and 62 positioned below the standard display digit 56 are not used during display of status information, but they are used during play-action simulation to show the positions of players. The decimal point 64 located to the right of the base of each digit is employed to simulate the flight of a ball during pass plays and kicks through sequential operation of adjacent decimal points. As shown in FIG. 3, the display conveys status information through the use of alphnumeric characters, but the same display is also used to simulate the objects whose simulated motion represents the play action of the game, as FIG. 13 shows.

Figure 8:
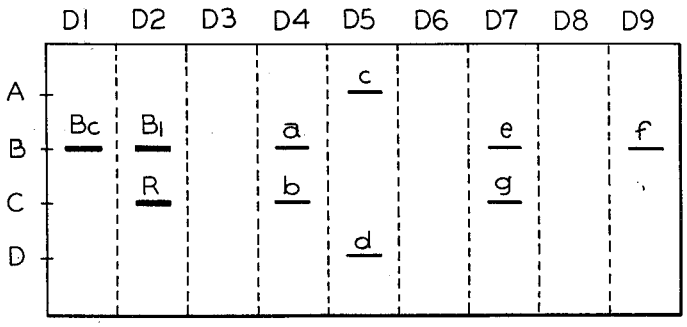
FIGS. 8, 9, 10, and 11 are simplified versions of the display showing the progress of a pass play.
Figure 13:
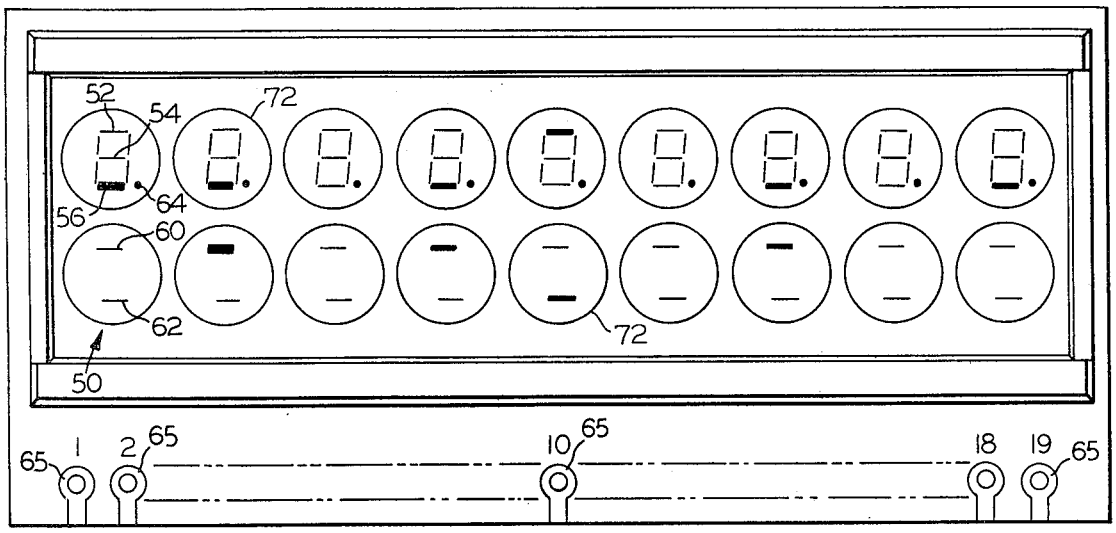
FIG. 13 shows the display panel of FIG. 3 displaying the FIG. 8 arrangement of players.

If the run/pass switch is in the "PASS" position, LED segments are illuminated initially as shown in FIG. 13. The FIG. 13 arrangement is shown simplified as before in FIG. 8. The offensive player designated R in FIG. 8 is the receiver, player $B_1$ is a blocker, and the ball carrier is designated $B_c$. As in the running play, there is no movement on either side until one of the directional keys is operated. In the pass play, however, operation of a directional key does not cause the ball carrier $B_c$ or blocker $B_1$ to move; only the receiver R moves according to directions from the control board, and it moves independently of the other two offensive players.

When the receiver executes the first move, the defensive players begin to move, thereby placing the ball carrier in danger of being tackled. Though the blocker $B_1$ of FIG. 8 cannot be moved during a pass play, it can still perform its blocking function; if a defender attempts to reach the ball carrier by going through blocker $B_1$, the defender is taken out of the play, as is blocker $B_1$. The defender taken out of play can no longer be used to tackle the ball carrier, but the ball carrier has lost its blocker, and tackling after the block becomes easier.

The object of the pass play, of course, is to complete a pass to the receiver. The ball is passed by depressing the pass/kick button 26, which causes the decimal points beginning at the position of the ball carrier to be illuminated in succession, thereby simulating the throwing of a pass. In order for the receiver to receive the pass, he must be in row B, the row occupied by the decimal points.

Figure 2:
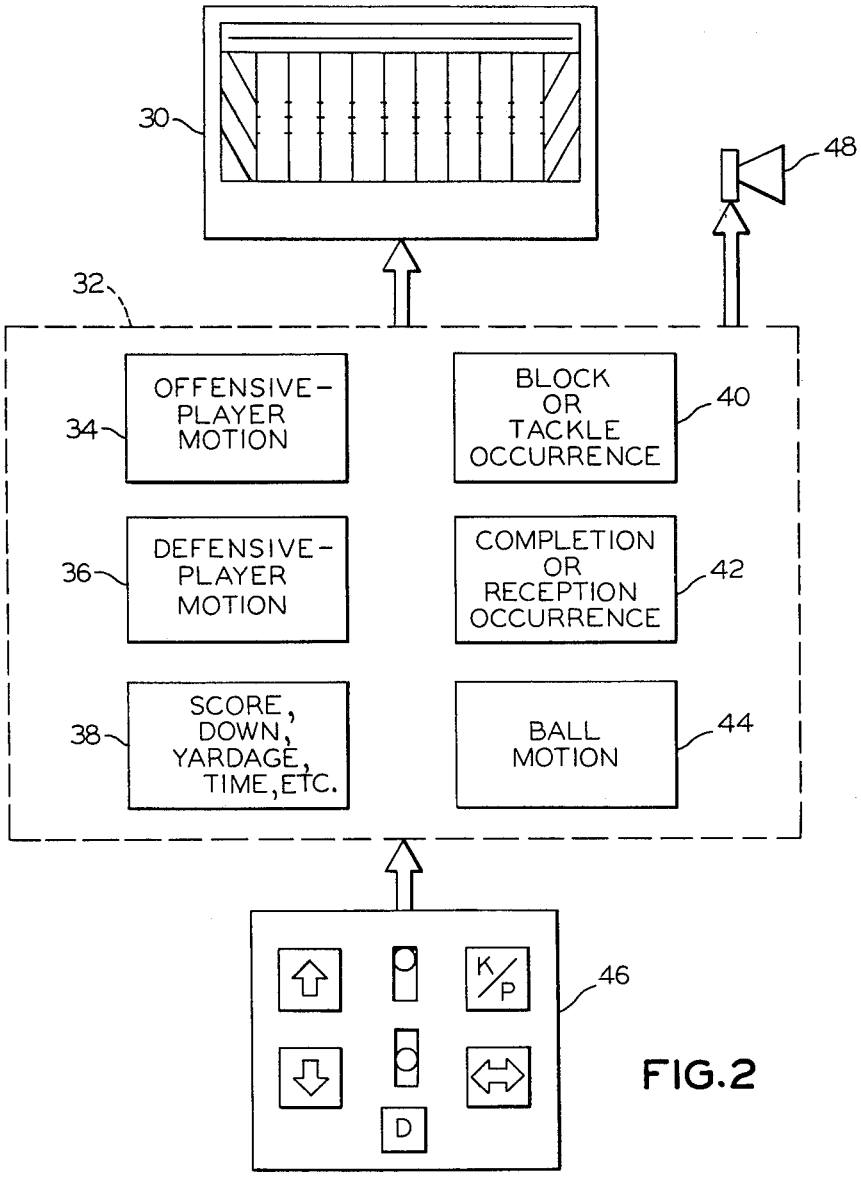
FIG. 2 is a block diagram showing the interdependence between the various functions of the apparatus of the preferred embodiment.
Figure 3:
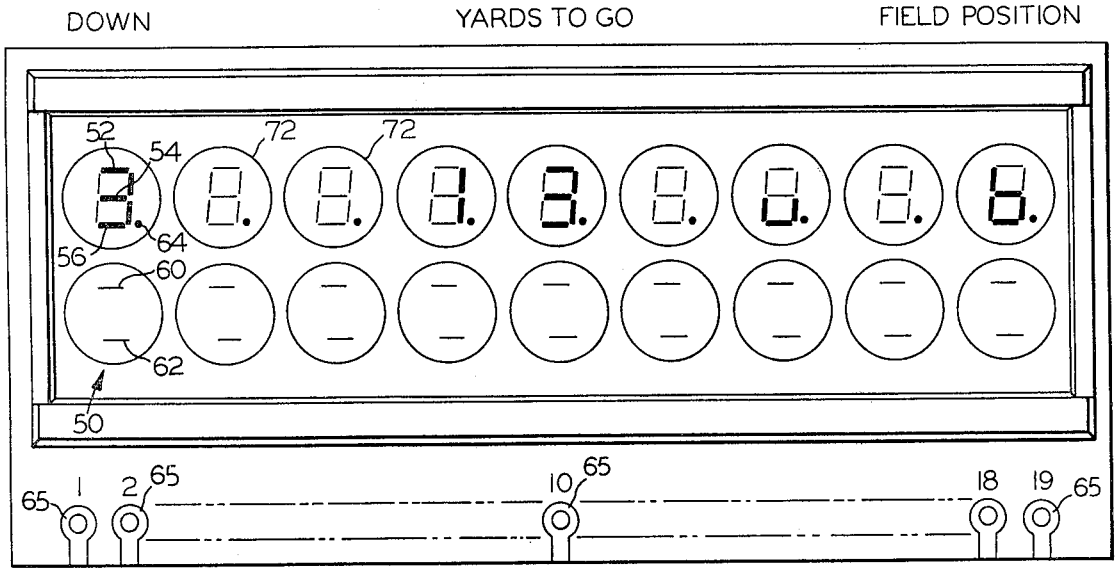
FIG. 3 shows the display panel of the preferred embodiment with the transparent upper surface removed, the display indicating the down, the yards to go for a first down, and the field position.

As suggested by blocks 42 and 44 of FIG. 2, the operational circuit is programmed to simulate the ball motion and to detect the coincidence of the ball and a receiver. When the receiver and the ball coincide, the receiver symbol starts blinking, thereby becoming a ball-carrier symbol. Movement of the new ball carrier is controllable from the control board until play stops as before upon the coincidence of a defensive player and the ball carrier.

In a pass play the repertoires of the four forward defenders a, b, c, and d, and the fifth optional defender, g, are the same as they were in the running play, and these defenders still attempt to tackle the ball carrier. Defenders e and f, on the other hand, are pass defenders, and in the pass mode they only move forward in a variable manner until defender e reaches column D5; once defender e reaches column D5, its repertoire and that of defender f change, allowing them only to move up and down in a variable manner.

In addition to their different movement repertoires, defenders e and f also differ from the other defenders in that they have the capability of intercepting a pass. If the ball coincides with any of the other defendants, there is no effect, either on the ball or on the defender; the coincident defender keeps up its variable-manner movement, and the ball continues on its way along row B. However, should the ball coincide with defender e or f, the completion/reception means 42 detects the coincidence, the ball disappears, and a turnover is effected.

At this point, it is to be remembered that the game is typically for use by two operators, one of whom controls the offensive players as they move to the right and the other of whom controls the offensive players as they move to the left. Thus, a turnover is effected by setting the players up on the next play in an orientation opposite to that on the previous play. For instance, assuming that the pass/run switch remains in the pass position, an interception occuring during a pass play that started in the position shown in FIG. 8 would cause the succeeding play to start in an arrangement that is the mirror image of FIG. 8. The ball carrier would start in row B, but in column D9 instead of D1, and the receiver, though starting in row C, would start in column D8 instead of D2. The positions of the other players would be similarly reversed.

The means for presenting and moving the ball, represented by block 44 in FIG. 2, is also used on a kick play. When the run/pass switch is in the "RUN" position, which is also labeled "KICK", the pass/kick key 20 can also be operated, but it has no effect unless the monitoring means 38 has determined that it is a fourth-down play. If it is a fourth-down play, operation of the pass/kick key 26 causes movement of the ball across the display. This movement of the ball simulates a kick, and the kick distance is assigned in a variable manner by the monitoring means 38. If the kick is determined by the monitoring means 38 to have been long enough, the offensive team is credited with a field goal. Otherwise, the position at which the erstwhile defensive side takes over the ball is determined by the yardage assigned to the punt.

It should be emphasized at this point that field position, as recorded by the monitoring means, has no effect on the position at which the line of scrimmage is simulated on the display panel; the ball carrier always starts the play in column D1 or D9, depending on which side has the ball. Thus, the position shown on the display at the end of a play represents only the amount of ground gained on the play, not the field position. The field position is indicated by the numeric characters resulting from operation of the "D" button 24.

Figure 7:
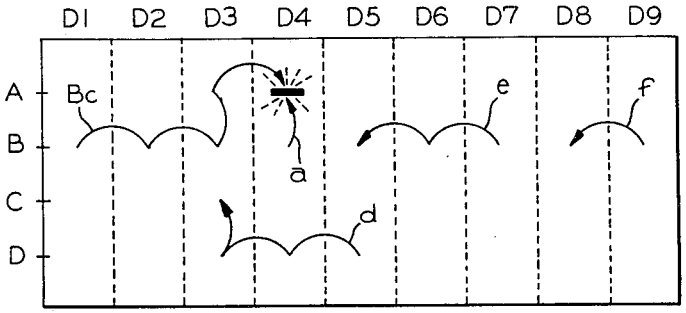
FIGS. 5, 6, and 7 are simplified versions of the display depicting the progress of a simulated running play.
Figure 6:
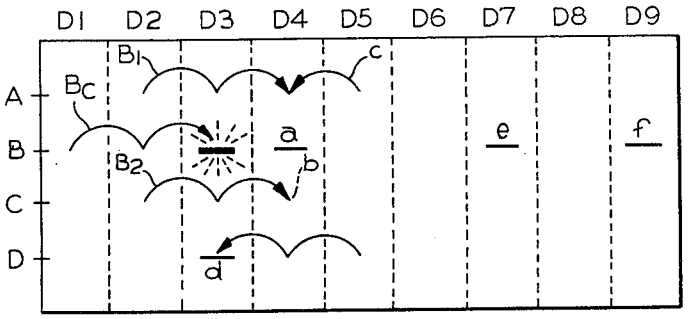

An example of a running play is shown in FIGS. 5–7. FIG. 5, as indicated previously, gives the normal lineup for a running play when the team advancing to the right has the ball. The ball carrier $B_c$ is in position in column D1 and row B, while blockers $B_1$ and $B_2$ are in column 2, rows A and C, respectively. Defenders a and b are in column D4, rows B and C, respectively, while defenders c and d occupy column D5, rows A and D, respectively. For purposes of the present illustration, it is assumed that the three-position switch 22 is in position 1, or the lower-skill position, which means that the defender g, which is not shown in FIGS. 6 and 7, is not present on the display. The position it would occupy in the skill-2 mode is shown in FIG. 5, however, and defenders e and g are shown occupying column D7, rows B and C, respectively. Finally, defender f is located in column D9, row B. FIG. 5 indicates the offensive players by lines that are heavier than those by which it indicates the defensive players. The heavier lines represent the fact that the offensive players are displayed more brightly. The ball carrier $B_c$ is further distinguished to represent the fact that it is blinking.

The players maintain the position shown in FIG. 5 until one of the directional buttons 16, 18, or 28 is depressed. As can be seen by referring to FIG. 6, the button 28 is first pressed in the example, causing $B_c$, $B_1$, and $B_2$ all to move forward one space. The pressing of directional button 28 also causes the variable-manner motion of the defenders to start, which is accompanied by a periodic ticking sound emitted by the sound-generating device. The ticks represent the passing of time; the ticks occur approximately once per second in real time, but each represents one-tenth of a minute in simulated time. Up to three defensive moves can occur per tick until the ball carrier reaches column D3.

In addition to the provision of a seventh defensive player, the movement of the three-position switch 22 to position 2 results in a different rate of defensive movement. In both position 1 and position 2, up to three moves can occur per tick when the ball carrier is behind D3 in left-to-right movement or D7 in right-to-left movement. After the ball carrier has advanced beyond that point, however, the rate of defensive play when the switch is in position 2 greatly accelerates, occurring at a rate of up to twelve moves per second. However, if the three-position switch 22 is in position 1, the rate of defensive play remains at a limit of three movements per second.

As is shown in FIG. 6, three defensive moves occur during the time (in this case) taken by the operator to depress the downfield button 28 twice and move $B_c$, $B_1$, and $B_2$ forward two spaces. One of the defensive moves is the forward move of defender c. The motion of defender c occurs in a variable manner in the sense that defender c may or may not move, depending on the determination of the defensive-motion means 36. However, once it is determined that defender c will move, its repertoire in the situation shown in FIG. 6 only contains one move, the one shown in FIG. 6. As was mentioned before, defender c can only move along a row until it arrives at the same column as that occupied by the ball carrier $B_c$. It is only when defender c reaches the same column as that of the ball carrier $B_c$ that it can move vertically toward the ball carrier $B_c$.

It is to be noted in FIG. 6 that blocker $B_1$ and defender c are only shown by arrows that point to the same position. This is to indicate that, the blocker and defender having moved to the same position, their coincidence was detected by a coincidence-detection means indicated by reference 40 in FIG. 2, and their display was therefore suppressed. Blocker $B_2$, which also moved in tandem with the ball carrier $B_c$, also encountered a defender, and its display and that of defender b was also suppressed.

Of the remaining defenders, defender d executed two forward moves, the only moves in its repertoire at that point, and defenders e and f were not chosen for movement by the defensive-motion means indicated by reference 36 in FIG. 2.

FIG. 7 shows the next moves executed by the ball carrier in response to commands from the control board. The first command resulted from the depression of the up button 16, which caused the ball carrier $B_c$ to move from row B to row A in column D3. Before the operatore pressed directional button 16, however, defenders e and f moved, e moving forward two spaces and f moving forward one space. Though the repertoires of defensive players e and f include both forward movements toward the column occupied by the ball carrier $B_c$ and up or down movements toward its row, the only choice in the situation presented by FIG. 7 was forward, since at the time of motion both defenders e and f were already in the same row as ball carrier $B_c$.

After the movements of defenders e and f, the ball carrier made its move upward, and this was followed by the movement of defender d. As previously indicated, defender d can only move forward until it reaches the column occupied by the ball carrier. In FIG. 7, however, defender d already occupies the same column as the ball carrier, so the only move open to it is up from row D to row C in column D3 as shown. The move of defender d was followed by a command from the control board resulting from the operation of directional button 28, causing the ball carrier $B_c$ to move forward in row A from column D3 to column D4. At that point, defender a was chosen in a variable manner, and the only move open to it was upward toward the ball carrier. This caused a coincidence between defender a and the ball carrier $B_c$, which was detected by the coincidence-detection means represented by block-or-tackle box 40 of FIG. 2. Play action was accordingly stopped, and display of all players except the ball carrier was suppressed, as seen in FIG. 7. The sound-generating device was operated to simulate a whistle blast, indicating the termination of play action at the position of the ball carrier $B_c$, whose display remained at the end of play action to indicate the amount of yardage gained on the play. In FIG. 7 the amount of yardage gain indicated by the position of the ball carrier $B_c$ is one yard. If the ball carrier had been tackled in column D1, a loss of two yards would have resulted; column D2 indicates a loss of one yard, D3 indicates no yards gained, D5 indicates two yards gained, D6 indicates three yards gained, D7 indicates four yards gained, D8 indicates five yards gained, and D9 indicates six yards gained. This information is stored by the monitoring means indicated by box 38 of FIG. 2, and when the operator presses the "D" button 24, the monitoring means takes this information into consideration in computing the field position that is displayed on the playing-field area of the display. The number of ticks, each of which indicates the passing of a simulated tenth of a minute, is also stored by the monitoring means, which takes this information into account in displaying the amount of time remaining if the operator again presses the "D" button.

Figure 9:
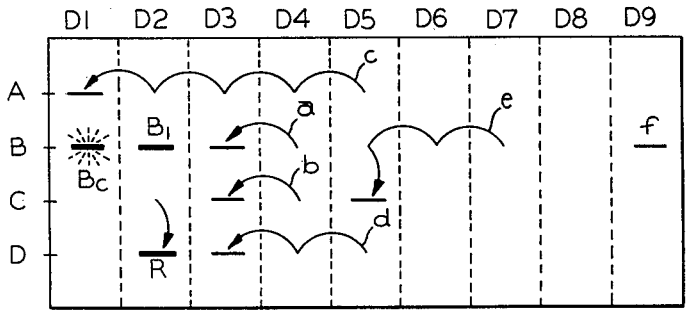

Should the operator switch the pass/run switch to the "PASS" position, the lineup will change to that shown in FIG. 8, in which the ball carrier $B_c$ and blocker $B_1$ occupy row B, columns D1 and D2, respectively. The other offensive player is now called the receiver and occupies row C, column D2. The defensive players occupy the same initial positions that they occupy at the beginning of a running play. The pass play in FIG. 9 is initiated by operation of down button 18, which causes the receiver to move down from row C to row D in column D2. As before, this begins the motion of the defensive players, and in the FIG. 9 example defender d immediately moves forward two spaces. The operator attempts to move the receiver forward by operating directional key 28, but the offensive-motion means represented in FIG. 2 by box 34 does not permit the receiver to move onto a space occupied by a defender. As the operator contemplates his next move, defender c can only move along a row toward the ball carrier's column at this point, so the picking of defender c for movement necessitates forward moves as shown in FIG. 9. Similar considerations require defender a to move forward when it is picked, and defender b is similarly constrained.

Defender e's pass-play repertoire requires that it move forward (along a row) toward the receiver's row until it reaches column D5. Once it reaches column D5, its repertoire consists of up or down movements along column D5. Defender f is also affected by the position of defender e; its repertoire changes from movement along a row to up or down a column at the same time as defender e's does.

Following the above rules, defender e is picked for three moves, by the first two of which it is placed in column D5. This changes its repertoire to up-or-down movements. It should be emphasized that upon arriving at row B, column D5, defender e has the option of moving up or down because its pass-play repertoire is not restricted to movements toward the receiver once it reaches column D5. Nonetheless, the movement of defender e in FIG. 9 upon arriving at column D5 is shown as being down, toward the row occupied by the receiver.

Figure 10:
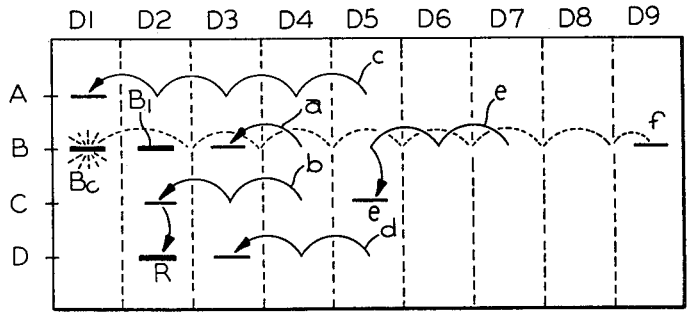

FIG. 10 illustrates the moves that follow those in FIG. 9. The operator, upon realizing that the receiver cannot move forward, decides to press the up button 16 in order to move the receiver to row B. Before he presses the button, however, defender b is picked twice for movement and executes forward steps, the only movements available in its repertoire at that position. This completely blocks the receiver, leaving the operator with no options for moving the receiver other than to wait until defender b has moved past. However, defender c is dangerously close to the ball carrier $B_c$, and one movement by defender c would result in the ball carrier being tackled, resulting in a loss of two yards.

The operator resolves to throw the ball away, so he presses the pass/kick key. This causes the operational-circuit means 32, which is programmed, as indicated by block 44, to provide a ball display, to place a ball symbol on the display and to move it to the right from the ball-carrier position. As noted above, the ball movement is accomplished by successively lighting adjacent decimal-point segments on the display. On its first movement, the ball coincides with blocker $B_1$. The operational-circuit means is programmed to detect coincidence between the ball and certain players, as is suggested by box 42 of FIG. 2. However, blocker $B_1$ is not one of the players whose coincidence with the ball is to be detected, and the ball continues on its way, unaffected by the presence of blocker $B_1$. The ball also encounters defender a, but defender a also is not one of the players whose coincidence with the ball is to be detected. Coincidence is only to be detected between the ball and either receiver R or one of the pass defenders e or f. The ball thus continues downfield, finally coinciding with defender f. Since defender f is a pass defender, the means indicated by box 42 in FIG. 2 causes an interception to be indicated. Though the players are still shown in FIG. 10, the result of an interception is the suppression of all of the players. Another indication of the interception is a three-whistle blast, simulated by the sound-generating device, which indicates a turnover. Another turnover indication is that the offense moves to the left rather than to the right when the players are lined up again, i.e., in the opposite direction.

Figure 11:
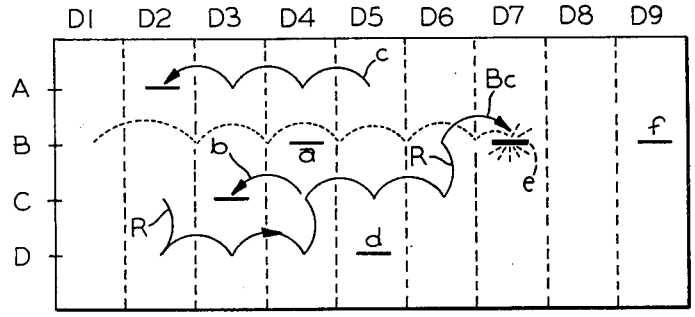

FIG. 11 shows a more successful pass play, again assuming the initial position shown in FIG. 8. Action is begun by depressing directional down button 18, which moves the receiver down to row D. The operation of directional key 18 is followed by two successive operations of downfield button 28, which advances the receiver to column D4, row D. Concurrently with these offensive plays, defensive player c executes three forward moves. Again, the repertoire of defensive player c is limited at this point to forward movements toward the ball carrier's column.

Upon reaching row D, column D4, the receiver is boxed in by defenders b and d. However, defender b, which keys on the ball carrier, not the receiver, obligingly moves forward one space, allowing the operator to operate up button 16, which moves the receiver up into row C. The receiver then advances two spaces in row C to column D6, and up button 16 is then operated to move the receiver up into row B. It is necessary for the receiver to be moved into row B because reception of a pass can only be accomplished in row B; row B is the only row with decimal points. The receiver having been maneuvered into row B, the pass/kick button 26 is operated, causing the ball to move forward as was illustrated in FIG. 10. Though the ball carrier $B_c$ and the blocker $B_1$ were both shown in FIG. 10 for clarity, the operational circuit actually suppresses their display after a pass has been thrown. This is indicated in FIG. 11 by the absence of ball carrier $B_c$ and blocker $B_1$.

As shown in FIG. 11, the ball continues on its journey, encountering defensive player a, which cannot intercept the pass, and continuing until it encounters receiver R. The coincidence between the ball and receiver R is detected, and a reception is indicated by the replacement of the steady receiver signal with the blinking ball-carrier signal. The operator then chooses to press downfield 28, causing the ball carrier to run right into defensive player e, resulting in a tackle. As is not shown in FIG. 11, all of the players are suppressed except the ball carrier, which remains on the display in column D7, thereby indicating a gain of four yards on the play. Again, the monitoring means records the gain on the play and the number of ticks of the clock that have occurred during play action and employs this information in generating the status displays triggered by pressing the "D" button.

Further features are also programmed into the device. One provided in the preferred embodiment is the playing of a simulated fight song upon the occurrence of a score. Another is the provision of variable yardage on kicks. As indicated before, a punt can be simulated on fourth down, and in the preferred embodiment the device assigns a variable distance to the punt, the distance having a nearly Gaussian distribution centered on 35 yards. A punt whose distance exceeds that to the goal line will be scored as a field goal which is scored as 3 points. However, a punt from 25 yards out does not guarantee that a field goal will result, and the fact that the kick occurs from the 50-yard line does not ensure that the field-goal attempt will be unsuccessful. Thus, the provision of a variable kick distance adds a measure of realism to the game.

Another provision that provides realism is the awarding of a safety when a team loses yardage in its own end zone. Two points are awarded the other team, which receives the ball and a first down on its 20-yard line. In the illustrated embodiment, points after touchdown are not played; seven points are automatically awarded for touchdowns.

Figure 12A:
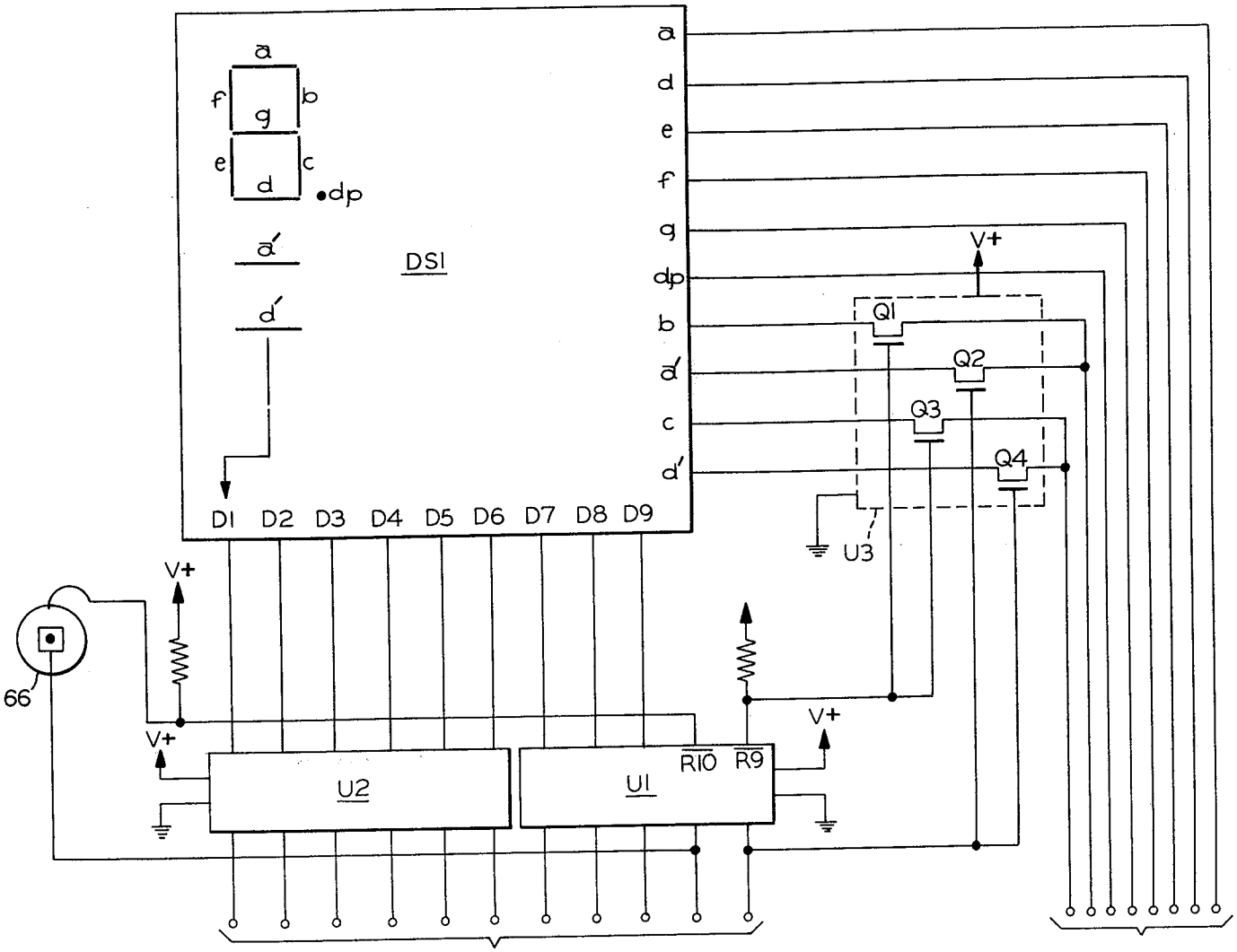
FIGS. 12A and 12B together form a schematic diagram showing a typical circuit for realization of the apparatus of the present invention.
Figure 12B:
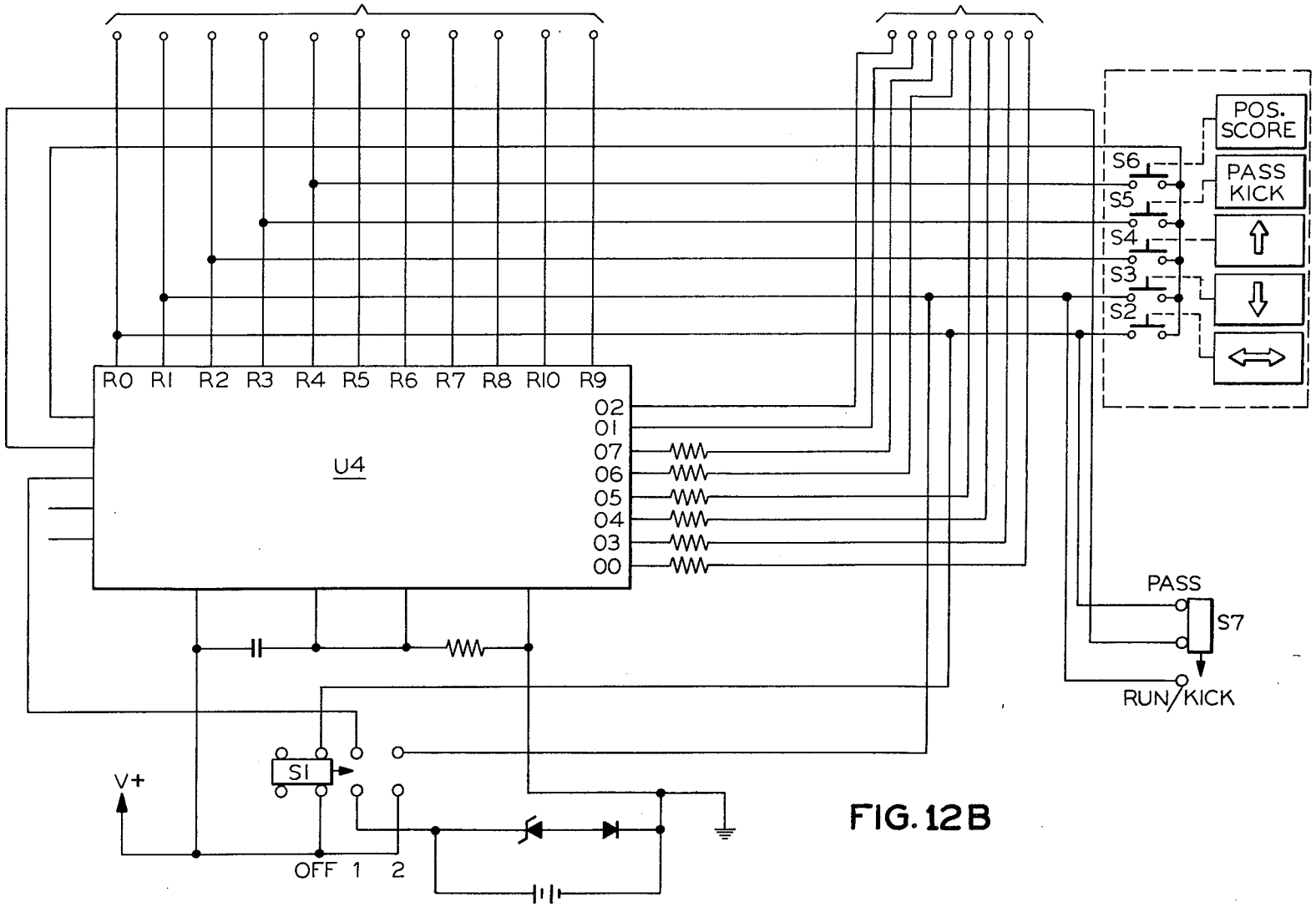

FIGS. 12A and 12B together form a schematic diagram of one circuit that can be used for realizaton of the preferred embodiment of the present invention. Bracketed groups of terminals in FIG. 12A represent the same circuit nodes as corresponding terminal groups in FIG. 12B. The elements of the schematic will be described generally; no attempt is made here to describe specifically the signals present on all of the lines in the schematic, because those skilled in the art will understand the operation from the designations of the functional elements.

The heart of the exemplary circuit is a single-chip microprocessor U4, a Texas Instruments TMS 1100, which has been programmed to provide the functions detailed above by mask programming a 2k×4-bit read-only memory. As will be understood by those skilled in the art, the final mask is developed in accordance with the purchaser's specifications.

Shown in FIG. 12A is the LED display DS1. DS1 is a display having the arrangement shown in FIG. 3. It is similar to commercially available seven-segments displays, but the a' and d' segments are the only ones present in the lower row of digits. The terminals labeled D1 through D9 on DS1 are column-selection terminals. Application of the appropriate level to one of these terminals enables further signals applied at the terminals labeled a through d' to light appropriate segments in the column. For instance, if it is desired to light segments a and d of the first column in FIG. 3, a signal is applied to terminal D1 of DS1 (FIG. 12A), and the appropriate signals are also applied simultaneously to terminals a and d. The terminals are driven according to signals produced by microprocessor U4 at its terminals labeled R0 through R10 and O0 through O7. The signals from microprocessor U4 that drive the column-selection terminals of the display are applied through driver chips U1 and U2 of FIG. 12A. The driver chips invert the signals applied to them and reduce the loading of the microprocessor outputs at terminals R0 through R10.

Operation of the segment-selection terminals of DS1 is controlled by means of output signals appearing on terminals R9 and O0 through O7 of U4. Since the specific chip U4 employed in the exemplary circuit does not have enough output lines to directly provide all of the inputs to the display DS1, gating circuits U3 (FIG. 12A) are provided. U3 allows the signals on terminals R9, O2 and O1 to provide four display inputs instead of three. For example, illumination of segment b' without illumination of segment a' requires that the appropriate signal be applied by the microprocessor U4 to its terminal O1 and consequently to the source terminals of Q1 and Q2 in chip U3. Simultaneously, the microprocessor U4 also provides an appropriate signal at terminal R9 that is applied to the gate of Q2 to prevent it from conducting. The complement of the signal on terminal R9 of the microprocessor U4 appears at output terminal $\overline{R9}$ of driver chip U1 and is applied to the gate of Q1 of chip U3, permitting it to conduct and to allow the signal from terminal O1 of microprocessor U4 to appear at terminal b of the display DS1. Segments b in the enabled columns are thereby illuminated while terminals a' in the same columns are not.

The other major components of the schematic are the battery BT1, which supplies power to the circuitry, the switches S1 through S7, which also appear in FIG. 1, and a piezoelectric transducer 66, the sound-generating device that provides the various sound indications previously mentioned. As can be deduced from FIGS. 12A and 12B, the complementary signals on terminal R10 of the microprocessor U4 and $\overline{R10}$ of the driver chip U1 are applied across the piezoelectric transducer 66 at various frequencies to produce the desired sound signals. The battery, of course, powers the unit, and it is apparent from FIGS. 12A and 12B that the switches can be operated to enter signals into the microprocessor chip U4, it being within the knowledge of those skilled in the art to program the mircoprocessor to interpret the entered signals.

The remaining discussion of FIGS. 12A and 12B explains the method of maintaining a complete roster of players on the LED display DS1 at any given time. As was indicated above, a signal on, say, terminal a of the display DS1 will illuminate the a segments on all of the columns enabled by appropriate signals on terminals D1 through D9 of the display DS1. Thus, it would appear that the appropriate way to light a segments in columns D2, D5, and D7 at the same time would be to apply signals simultaneously to their enabling terminals. However, this would cause a problem if it were also desired to illuminate the d segment of column D1 alone, because a signal on the d terminal would also cause d segments in enabled columns D2, D5 and D7 to light. In order to avoid this the display is multiplexed. That is, no two columns are displayed at the same time; as a matter of fact, different parts of the same column are driven at different times. But the columns all displayed frequently enough so that their illuminations appear steady. By appropriate timing, this multiplexing effects the differences in brightness between the offensive players and the defensive players; the segments representing defensive players are pulsed less frequently than those that represent offensive players, so the defensive players appear to be dimmer.

Figure 14:
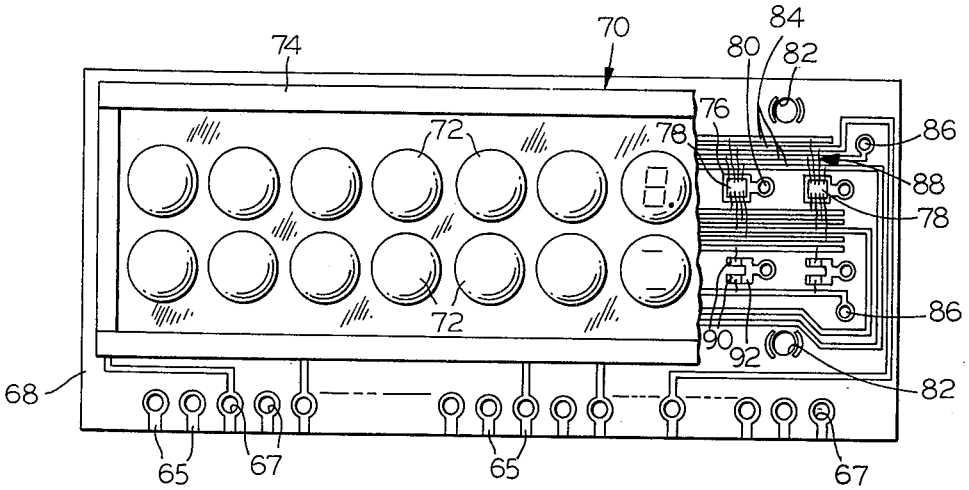
FIG. 14 shows the display panel, again with the transparent upper surface removed, the lens plate being partially cut away to reveal the underlying circuit board.
Figure 16:
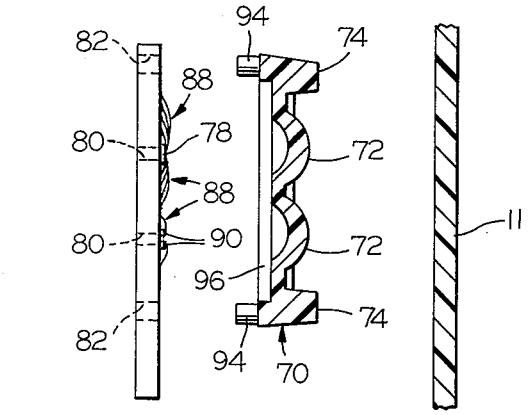
FIG. 16 is an exploded side elevation, partially in section, of the display panel of the preferred embodiment.
Figure 15:
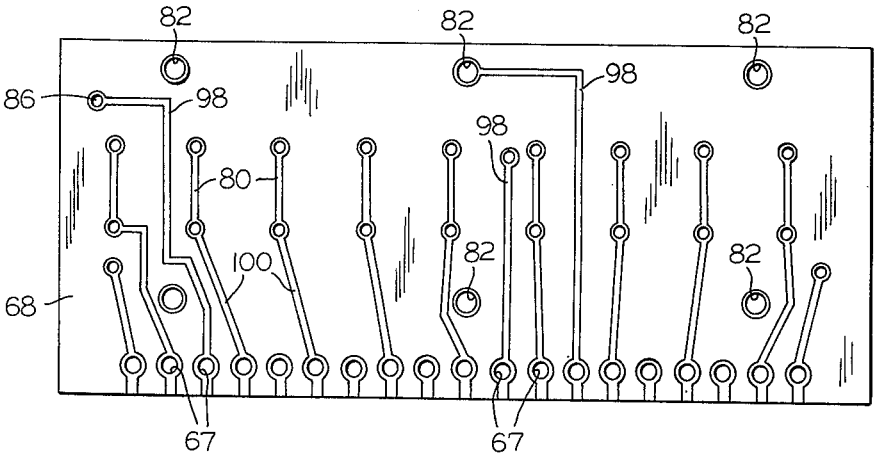
FIG. 15 shows the lower surface of the circuit board revealed in FIG. 14.

FIGS. 14, 15, and 16 show the display panel of the preferred embodiment in greater detail. FIG. 14 is a plan view of the display with the upper part of the housing 10 and the transparent planar upper surface 11, which is mounted in the upper part of housing 10, removed. A lens plate 70 sits on a circuit board 68. The lens plate 70 is made of clear plastic and has eighteen hemispherical lenses 72 formed in it for magnifying objects positioned beneath them. Beneath each lens in the top row of lenses is mounted an LED chip 78 that includes eight light-emitting diodes positioned with respect to each other in the form of a seven-segment display digit and a decimal point. The cathodes of all the light-emitting diodes formed in a single chip 78 are connected to a common cathode land area 76 for application of a common cathode signal thereto. The land area 76 includes a plated-through hole 80 that connects the land area 76 to a conductor path on the bottom side of the circuit board 68. The bottom side of the circuit board is shown in FIG. 15, where it is seen that pairs of plated-through holes 80 are connected to each other and to terminals 65 through conductor paths 100 formed on the bottom of the circuit board 68. Each connected pair of plated-through holes 80 includes one hole 80 that is electrically connected to a common cathode land area 76 for a seven-segment chip 78, and another plated-through hole 80 that is electrically connected to a common cathode land area 92 (FIG. 14) for two other chips 90. Each of the chips 90 is a single-LED chip that forms one of the two extra segments 60 and 62 (FIGS. 3 and 13) in each column in the display. Thus, the cathodes of all of the LED's that make up the display of a single column in the display panel are connected together electrically, so a signal can be applied to all the cathodes in a column by applying the signal to the appropriate one of the terminals 65.

The various anodes of the chips 78 and 90 in a given column are connected to separate terminals 65 so that each of the LED's within a given chip can be addressed individually. Electrical connections are made to the anodes through conducting whiskers 88 that are connected to the chips and to conductor paths 84 on the upper surface of the circuit board 68. Corresponding LED's on different chips have their anodes connected to the same paths so that a signal connected applied to the anode of, say, the decimal-point LED of one chip is also applied to the anodes of the decimal-point LED's of all the other chips. Some of the conductor paths 84 are connected to the terminals 65 by paths on the upper surface of the circuit board 68, while others are connected through plated-through holes 86 and conductor paths 98 (FIG. 15) to plated-through holes 67 that are connected to the terminals 65. Accordingly, in order to illuminate an LED, it is necessary to apply a relatively negative voltage signal to the terminal connected to the common cathode for the chip in which the LED is formed and to apply a relatively positive signal to the terminal that is connected to the anodes of the selected LED and the LED's corresponding to it. This is the explanation for the requirement discussed in connection with FIG. 12A for applying an appropriate signal both to a terminal on the lower edge of DS1 and a terminal on the right edge of DS1. The terminals on the lower edge of DS1 all represent terminals connected to the common cathodes, while the terminals on the right edge represent terminals that interconnect the anodes of corresponding LED's.

FIG. 16 is an exploded view showing the lens plate 70 and part of the planar surface 11 in section and the circuit board 68 in side elevation. When assembled, the transparent planar upper surface 11 is mounted on shoulders 74 formed in the lens plate 70. Mounting bosses 94 are formed on the bottom of the lens plate 70 and fit into holes 82 in the circuit board 68. As can be seen in FIG. 16, the chips 78 and 90 are quite small, and they cannot be seen well with the unaided eye. As a result, the lenses 72 are provided to magnify the images produced by the LED's.

From the foregoing description of FIGS. 14, 15, and 16 it can be seen that the display is operated by applying a relatively positive signal to one of the terminals 65 that is electrically connected to one of the anode paths and at the same time applying a relatively negative signal to one of the terminals 65 that is connected to a cathode path. Current then flows from the anode-path terminal along one of the conductors 84 and through a conducting whisker connector 88 to the selected LED. The current flows through the LED to the common cathode land area 76 to which it is connected, and it flows from there through one of the plated-through holes 80 and a conductor path 100 to the selected cathode terminal 67. The flow of current through the diode causes it to emit light, and this light passes through the lens 72 that covers it so as to magnify it for easy viewing with the unaided eye.

It is apparent that the arrangement just described permits LED's in the standard seven-segment patterns to be used to form alphanumeric symbols for displaying status information. However, at least some of the LED's in those same displays can also be used to depict the play action of the simulated game. As a result, display area and the accompanying expense can be saved by avoiding the provision of extra display area to be used for conveying status information.

Having thus described the invention, I claim:

1. In an apparatus for simulating a sports-action game that includes:

A. a display panel providing a playing area with a transparent planar surface and including an array of light-emitting devices disposed below said playing area and operable to emit light to provide a visual simulation representative of the simulated sports-action game by the application of electrical signals thereto;

B. operational-circuit means operatively connected to said display panel playing area and including means for generating and transmitting electrical signals to at least some of said light-emitting devices below said playing area to illuminate said devices to simulate at least one object, some of said devices being illuminated sequentially to simulate at least one moving object whose simulated motion on said playing area represents the play action of said simulated sports-action game, said operational-circuit means further including means for monitoring said play action to record information concerning the status of said simulated game and for generating and transmitting electrical signals representative of said status information; and C. a control board including a multiplicity of manually operable control elements, said control board being connected to said operational-circuit means for transmission of signals to said operational-circuit means through operation of said control elements, said means for generating and transmitting signals to said light-emitting devices being arranged to produce manually controlled movement of at least one of said simulated objects in said playing area in response to signals transmitted from said control board, the improvement wherein:

at least some of said light-emitting devices are seven-segment displays with decimal points therebetween, at least some of said light-emitting devices below said playing area are alternately illuminated in a plurality of modes through action of said operational-circuit means resulting from signals from said manually operable control elements with object simulating signals being transmitted to said devices in one mode and status information signals being transmitted thereto in another mode, illumination in said one mode simulating said object with said manually operable control elements producing manually controlled movement of said object on said playing area during the period of play action, illumination in said another mode displaying said status information in said playing area in response to said electrical signals from said play action monitoring means upon termination of said play action, illumination in said one mode by said operational-circuit means effecting illumination only of the horizontal segments of the seven-segment displays and of the decimal points to provide said simulated objects, illumination in said other mode by said operational-circuit means effecting illumination of both horizontal and vertical segments of said devices as well as such decimal points as required.

2. The apparatus of claim 1 wherein said monitoring means generates and transmits signals to at least some of said light-emitting devices to illuminate said devices to form alphanumeric symbols that convey said status information.

3. The apparatus combination of claim 1 wherein said light-emitting devices are light-emitting diodes.

4. The apparatus combination of claim 1 further including a housing adapted to be held in a human hand, and wherein said operational-circuit means are contained in said housing and said display panel is mounted on said housing.

5. The apparatus combination of claim 1 wherein said planar upper surface has a simulated playing field inscribed thereon above said light-emitting devices.

6. The apparatus combination of claim 5 wherein said display panel further includes at least one lens, positioned between said planar surface and at least one of said light-emitting devices, for magnifying the image of at least one of said light-emitting devices.

7. The apparatus combination of claim 6 wherein said display panel further includes circuit-board means disposed below said light-emitting devices, said light-emitting devices being mounted on said circuit-board means, said circuit-board means including conductor paths and circuit-board terminals in which said conductor paths terminate, said conductor paths being electrically connected to said light-emitting devices for illumination of selected light-emitting devices upon application of electrical signals to selected circuit-board terminals, said operational-circuit means being operatively connected to said circuit-board terminals to transmit said electrical signals thereto to simulate said object and display said status information.

8. The apparatus combination of claim 7 wherein said display panel includes a multiplicity of lenses organized into at least two rows.

9. In a method for playing an electronic simulated sports action game, the steps of:

A. providing a display panel playing area that includes an array of light-emitting devices disposed therebelow and operable to emit light to provide a visual simulation of the sports-action game by the application of electrical signals thereto, having at least some of said light-emitting devices comprise seven-segment displays and decimal points therebetween;

B. providing operational-circuit means operatively connected to said display panel playing area and including means for generating and transmitting electrical signals to at least some of said light-emitting devices below said playing area to illuminate only the horizontal segments and decimal points of said devices to simulate at least one object, having some of said devices illuminated sequentially to simulate at least one moving object whose simulated motion in said playing area represents the play action of said simulated sports-action game, having said operational-circuit means further include means for monitoring said play action to record information concerning the status of said simulated game and for generating and transmitting signals to at least some of said light-emitting devices below said playing area to illuminate the horizontal and vertical segments and decimal points of said devices to display said status information in said playing area, activating at least some of the horizontal segments and decimal points of said light-emitting devices below said playing area by alternately illuminating in a plurality of modes through said operational-circuit means with object simulating signals being transmitted thereto to illuminate both horizontal and vertical segments of said seven-segment displays and the decimal points in said devices in another mode, illumination in said one mode simulating said object, illumination in said another mode displaying said status information in said playing area;

C. providing a set of manually operable control elements electrically connected to said operational-circuit means for transmission of electrical signals to said operational-circuit means through operation of said manually operable control elements, said means for generating and transmitting electrical signals to said light-emitting devices to simulate said at least one object being arranged to produce manually controlled movement in said first mode of at least said one simulated object on said playing area in response to signals transmitted from said control board during play action, and said operational-circuit means being arranged for alternate selection of object simulation and status-information display in response to electrical signals transmitted from said manually operable control elements; and D. operating said manually operable control elements to alternately select simulation of said objects during play action and display of said status information upon termination of play action, thereby using some of the same light-emitting devices for alternately simulating said objects and displaying said status information in said playing area.

10. The method of claim 9 further including the step of producing manually controlled movement of at least said one simulated object on said playing area by operating said manually operable control elements.

* * * * *

UNITED STATES PATENT AND TRADEMARK OFFICE

CERTIFICATE OF CORRECTION

PATENT NO. : 4,327,915

DATED : May 4, 1982

INVENTOR(S) : ERIC BROMLEY

It is certified that error appears in the above—identified patent and that said Letters Patent is hereby corrected as shown below:

Column 17, line 26, delete "7" and substitute -- 6 --.

Signed and Sealed this

*Fifth* Day of *October 1982*

[SEAL]

*Attest:*

GERALD J. MOSSINGHOFF

*Attesting Officer*

*Commissioner of Patents and Trademarks*